US012678004B2

(12) United States Patent
Van Der Wensch

(10) Patent No.: US 12,678,004 B2
(45) Date of Patent: Jul. 14, 2026

(54) USER-GUIDED SELF-PROPELLED CLEANING DEVICE

(71) Applicant: WENSCH HOLDING B.V., Oisterwijk (NL)

(72) Inventor: Adrianus Josephus Antonius Van Der Wensch, Oisterwijk (NL)

(73) Assignee: WENSCH HOLDING B.V., Oisterwijk (NL)

( * ) Notice: Subject to any disclaimer, the term of this patent is extended or adjusted under 35 U.S.C. 154(b) by 416 days.

(21) Appl. No.: 18/021,896

(22) PCT Filed: Aug. 2, 2021

(86) PCT No.: PCT/NL2021/050487
§ 371 (c)(1),
(2) Date: Feb. 17, 2023

(87) PCT Pub. No.: WO2022/039591
PCT Pub. Date: Feb. 24, 2022

(65) Prior Publication Data

US 2023/0389763 A1 Dec. 7, 2023

(30) Foreign Application Priority Data

Aug. 17, 2020 (NL) ..... 2026276

(51) Int. Cl.
*A47L 11/40* (2006.01)
*A47L 11/164* (2006.01)
*A47L 11/30* (2006.01)

(52) U.S. Cl.
CPC ..... *A47L 11/164* (2013.01); *A47L 11/305* (2013.01); *A47L 11/4066* (2013.01); *A47L 11/408* (2013.01)

(58) Field of Classification Search
CPC .... A47L 11/164; A47L 11/283; A47L 11/293; A47L 11/16; A47L 11/4036;
(Continued)

(56) References Cited

U.S. PATENT DOCUMENTS 3,781,937 A 1/1974 Jacobs
5,333,345 A * 8/1994 O'Donnell ..... A46B 5/007 16/431
(Continued)

FOREIGN PATENT DOCUMENTS

EP 0978249 A2 2/2000
EP 2756787 A1 7/2014
(Continued)

OTHER PUBLICATIONS

International Search Report (ISR) for PCT/EP2019/054818 mailed Nov. 10, 2021 (4 pages).
(Continued)

*Primary Examiner* — Michael D Jennings
(74) *Attorney, Agent, or Firm* — NIXON PEABODY LLP

(57) ABSTRACT

A user-guided self-propelled cleaning device for cleaning a surface, having a frame which includes at least two tools and at least one drive, the at least two tools being rotatable on the surface by said at least one drive, wherein, when the self-propelled cleaning device is placed on the surface, each of the tools is inclined over at least one respective angle $\Gamma_1$, $\Gamma_2$, $\alpha_1$, $\alpha_2$ with respect to the surface, and wherein the two tools are configured to rotate in mutually different directions in an operative state of the self-propelled cleaning device, thereby exerting a propulsive force on the frame, (Continued)

wherein said inclination angle $\Gamma_1$, $\Gamma_2$, $\alpha_1$, $\alpha_2$ is variable by manipulation, by a user, of a control element, to vary the propulsive force exerted on the frame.

12 Claims, 9 Drawing Sheets

(58) Field of Classification Search
CPC ..... A47L 11/4038; A47L 11/4063; A47L 11/4066; A47L 11/4069; A47L 11/08; A47L 11/26
USPC ..... 15/21.1, 144.1–144.2
See application file for complete search history.

(56) References Cited

U.S. PATENT DOCUMENTS

2015/0113757 A1* 4/2015 Franke ..... A47L 7/0023 15/3
2019/0208978 A1* 7/2019 Shitamoto ..... A47L 11/305
2020/0129034 A1* 4/2020 Krebs, Jr. ..... A47L 11/4011
2020/0154968 A1* 5/2020 Terry ..... A47L 11/4088
2023/0346188 A1* 11/2023 Franke ..... A47L 11/305

FOREIGN PATENT DOCUMENTS

EP 2832277 A2 2/2015
EP 2832277 B1 9/2016
EP 3508106 A1 7/2019
WO 2019207290 A2 10/2019
WO 2020234904 A1 11/2020

OTHER PUBLICATIONS

Written Opinion of the International Search Authority (WO) for PCT/EP2019/054818 mailed Nov. 10, 2021 (5 pages).

* cited by examiner

USER-GUIDED SELF-PROPELLED CLEANING DEVICE

BACKGROUND OF THE INVENTION

The present invention relates to a self-propelled cleaning device, as well as a method for cleaning a surface.

EP2832277B1 for example discloses a hand-guided floor treatment device having a bottom part which includes at least one tool which is rotatable on a floor by means of a drive, and having a guide part which includes at least one handle and is connected to the bottom part by means of an articulated arrangement, which articulation is designed such that the guide part, proceeding from a perpendicular, is pivotable in relation to the perpendicular to angular positions revolving in all directions and is operatively connected to the bottom part so as to transmit torque in an angularly limited manner in any angular position in relation to the perpendicular, wherein the floor treatment device is implemented as a wet cleaning machine, in particular as a scrubber-drier machine, and comprises a suction strip arrangement, which—when viewed in the direction of propulsion—is arranged behind the rotatable tool and in operation rests on the floor. The device of EP2832277B1 is characterised, in that the at least one rotatable tool is arranged on the bottom part in such a manner that, when the floor treatment device is operating, the at least one rotatable tool exerts permanent linear propulsion on the bottom part. The device of EP2832277B1 is further characterised, in that a suction drive for the suction strip arrangement is incorporated in the guide part.

EP2756787A1 relates to a robot cleaner capable of moving in diverse directions and enhancing cleaning efficiency by increasing frictional force between a pad and a floor. The robot cleaner includes two or more driving units. A rotating plate assembly is configured to be slanted with respect to a floor by rotation of a first subframe and to rotate clockwise or counterclockwise by receiving rotational force from another motor. When the rotating plate assembly is slanted with respect to the floor, nonuniform frictional force is generated between the pad and the floor, through which the robot cleaner travels.

SUMMARY OF THE INVENTION

The invention is based on the insight that in certain cases it is undesirable when a cleaning device moves with a permanent linear propulsion force (i.e. with a constant speed). It may be desirable to vary the forward speed of such a known cleaning device. This would e.g. allow the device to speed up when a surface with a below-average dirtiness is to be cleaned, and this would e.g. also allow the device to move slower when a certain part of the surface is to be cleaned more thoroughly. Depending on the exact dirtiness of the surface, this may result in a faster and/or better cleaning treatment, while the cleaning device would also be more convenient to use for a user. As on different days and on different locations the dirtiness of the surface to be cleaned may vary, preferably a machine operator can control the speed and the cleaning intensity of the cleaning device.

Accordingly in a first aspect of the present invention, a user-guided self-propelled cleaning device for cleaning a surface is provided, the cleaning device having a frame which includes at least two tools and at least one drive for rotating the at least two tools on the surface, wherein, when the user-guided self-propelled cleaning device is placed on the surface, each of the tools is inclined over at least one respective angle $\Gamma_1$, $\Gamma_2$, $\alpha_1$, $\alpha_2$ with respect to the surface, and wherein the two tools are configured to rotate in mutually different directions in an operative state of the self-propelled cleaning device, thereby exerting a propulsive force on the frame, wherein the device further comprises a control element for control of the user-guided self-propelled cleaning device by a user of the device, wherein said inclination angle $\Gamma_1$, $\Gamma_2$, $\alpha_1$, $\alpha_2$ is variable by a manipulation of the control element by the user, to vary the propulsive force exerted on the frame.

Advantageously, by allowing the inclination angle of the tools to vary, the propulsive force exerted on the floor can be varied and the propulsive speed of the cleaning device may be varied. The user controls the operation of the cleaning device and determines where more extensive cleaning might be needed, and where less extensive cleaning might be needed. This on the one hand minimizes the cleaning time and, simultaneously, on the other hand increases the quality of the cleaning result.

In one example, when a certain area of the surface to be cleaned is relatively dirty, so-called spot-cleaning may be necessary. Spot-cleaning is a term well known to one skilled in the art and may e.g. relate to 'cleaning one spot with high intensity'. When the speed of the cleaning device is variable by control of the user, it becomes possible to move very slowly over one particular area of the surface, and to clean this area with high intensity when an operator has recognized the need for spot cleaning. It may even be possible to operate the cleaning device on one and the same spot for a period of time, e.g. when the propulsive speed equals zero. In previously known cleaning devices the device had to be moved back and forth over an area to allow such spot cleaning and/or spot cleaning would not be done as it is inconvenient to move the cleaning device back and forth manually. The herewith presented cleaning device thus is either more convenient to use and/or results in an improved cleaning of the surface.

In another example, when a certain area of the surface is hard to reach, e.g. below a table or in a corner, it may be desirable to vary the propulsive speed of the cleaning device by changing the inclination of the tools, to operate the device with more precision and clean the surface better. In previously known cleaning devices the device had to be moved back and forth to allow such hard to reach areas of the surface to be properly cleaned and/or it would not be done at all and/or it would require a highly-experience user. With the presently disclosed cleaning device, cleaning such hard to reach areas is thus now advantageously either more convenient and/or results in an improved cleaning of the surface and/or can be done by less experienced users.

In yet another example, when a certain area of the surface requires little or no cleaning, it is possible to increase the forward speed of the cleaning device by increasing the inclination angle of the tools to advantageously clean this area in less time. The user/operator of the device will be able to determine the optimal speed, based on his/her experience.

Further advantageously, the cleaning device as presented herein can be kept on the same spot when starting and/or stopping it. In previously-known device the device would "run away" when started, which could lead to dangerous and/or inconvenient situations when a user with little experience does not expect this. Therefore, known cleaning devices comprise a "dead-man-switch" which must be activated at all times in order for the device to work. The occurrence of such situations is now resolved and safe operation of the cleaning device may be guaranteed without having a dead-man-switch.

Furthermore advantageously, when the inclination angles of the tools are, additionally, individually controllable, on top of changing the speed with which the cleaning device is propelled also the direction of propulsion may be controlled. By changing the inclination of only one of the tools, a turn may automatically be made with the cleaning device. This will be described in more detail in the below.

The cleaning device according to the present disclosure is "self-propelled". As is well known in the art of professional cleaning devices, when the tools of the cleaning device are inclined at an angle with respect to the surface to be cleaned and when they rotate in mutually different directions, a propulsive force is exerted on the cleaning device. No external drive is then necessary to allow the cleaning device to move forward. In accordance with the present disclosure, with a variable inclination angle the forward speed with which the device is propelled may vary and may be positive, zero or negative at any given time. More specifically, the cleaning device is self-propelled and user-guided. This means that, advantageously, a user or operator ultimately is in control of the cleaning device and can control where more cleaning is needed and where quicker and less intense cleaning is sufficient. Advantageously, as the cleaning device is self-propelled, the user/operator does not need to push the cleaning device or exert any other forces to make the device go forward, but can simply suffice with walking behind the cleaning device.

The device according to the present disclosure is a "cleaning device" and may e.g. be a so-called scrubber machine or a so-called scrubber-drier machine which cleans a surface with water and detergent. The device may alternatively e.g. be a polishing machine which optically treats a surface so that it shines. Further alternatively the device may be a sweeping machine.

The cleaning device according to the present disclosure is configured to clean a surface. For example said surface is a floor, the floor e.g. being arranged horizontally or at an inclination with respect to the horizon. For example said surface is a wall, a ceiling, or any other type of surface, arranged horizontally, vertically, slanted or curved.

The cleaning device according to the present disclosure comprises at least two tools. Of course, in certain embodiments it is very well possible that the cleaning device has three, four, or even more rotatable tools.

The cleaning device according to the present disclosure comprises at least one drive. In certain embodiments, one drive drives all tools. In other embodiments, each tool may be coupled with its own drive. In yet further embodiments, there are e.g. four tools and two drives, or any other combination of number of tools and number of drives.

According to the present disclosure, each of the tools of the cleaning device is inclined over at least one respective angle. It is explicitly noted that this angle, depending on the desired propulsive speed of the cleaning device, may be negative, positive, or zero. As will be explained in more detail in the below, at times the inclination angles of the two tools may be different from each other.

According to the present disclosure, the magnitude of the inclination angle of the tools is variable. For example the inclination may be varied between a number of pre-set positions, or the inclination may be continuously varied. For example, depending on the desired cleaning mode, the inclination may be anywhere between −2° and +4°, including approximately 0°, approximately 0.5°, approximately 1°, approximately 1.5° and approximately 2°.

In an embodiment according to the first aspect of the present disclosure, said inclination angle $\Gamma_1$, $\Gamma_2$ is defined in or has a component when projected on an imaginary YZ plane of an imaginary XYZ axis system that has an origin in a central position with respect to the at least two tools, an X-axis that coincides with a propulsion direction of the user-guided self-propelled cleaning device, a Z-axis that coincides with a direction normal to the surface, and the Y-axis that points to the right of the frame and completes the XYZ axis system.

The YX plane is what most people intuitively would refer to as the "frontal view" of the cleaning device. An inclination of the tools in this plane, combined with a counter-rotating movement, allows the tools to effect a propulsive force on the frame. Roughly speaking, for the same rotation rpm, a lower inclination will result in a lower propulsive speed whereas a larger inclination will result in a higher propulsive speed and no inclination will result in a stand-still of the device.

In an embodiment according to the first aspect of the present disclosure, the user-guided self-propelled cleaning device has an articulated arrangement and a top part that includes at least one handle, wherein the top part is connected to the frame via said articulated arrangement, and wherein the top part is preferably pivotable in all angular directions with respect to the frame.

Advantageously, such a cleaning device with handle and articulated arrangement is very convenient in use for a user as it is easily operated.

In one embodiment, the articulated arrangement may comprise two hinges. Each hinge allows the handle to be rotated about a respective hinge axis, the hinge axes of the two hinges preferably being arranged perpendicular to one another; one hinge axis preferably being arranged parallel to the direction of movement and allowing the handle to be moved to the left or to the right when seen from the perspective of the user; the other hinge axis preferably being arranged perpendicular to the direction of movement and allowing the handle to be moved forwards and backwards when seen from the perspective of the user. This results in a cleaning device having a handle that can be rotated 360 degrees compared to the frame.

In another embodiment, the articulated arrangement may comprise one hinge defining one hinge axis, the hinge axis e.g. being arranged parallel or perpendicular to the direction of movement of the cleaning device. Another direction of movement may be provided by a deformable elastomeric member, the deformable elastomeric member, due to its inherent flexibility, allowing the handle to be bend towards the other direction to obtain a handle that can be rotated 360 degrees compared to the frame.

In another embodiment, the articulated arrangement is defined by a deformable elastomeric member having a 360 degrees movement direction.

In an alternative embodiment according to disclosure, the self-propelled cleaning device is robotic and can e.g. be operated remotely or pre-programmed with a cleaning route. When the cleaning device is of the robotic type and self-propelled, advantageously no traces (such as wheel imprints) are left behind on the cleaned floor. For example, the robotic cleaning device may be self-learning so that it can learn the optimal cleaning route of a room. For example the robotic cleaning device may use virtual learning or artificial intelligence to be self-learning.

In an embodiment according to the first aspect of the present disclosure, the self-propelled cleaning device is a scrubber-drier having a water outlet at or near the rotatable tools and a suction strip arranged, when seen in a propulsion direction, behind the rotatable tools.

Advantageously, such a scrubber-drier allows a user to walk behind the cleaning device without stepping on a wet area and leaving traces such as foot imprints.

In an embodiment according to the first aspect of the present disclosure the control element is defined by the top part and the manipulation is defined by a backwards and/or forwards movement of the handle.

Advantageously this results in a cleaning device which is very intuitive to use.

At the same time and/or alternatively the inclination angle $\Gamma_1$, $\Gamma_2$, $\alpha_1$, $\alpha_2$ of said tools may be variable by manipulation of the handle of the top part in a sidewards direction.

Advantageously this results in a cleaning device which is very intuitive to use.

In an embodiment according to the first aspect of the present disclosure a mechanical linkage system couples the movement of the handle and the movement of the tools.

Advantageously, a mechanical linkage system is typically robust, it is easy to spot the need for repairs and in general is quite cost-effective.

In an embodiment according to the first aspect of the present disclosure the handle of the top unit includes a handle position sensor configured for determining an angular position of the handle, wherein the frame includes a tool angle controller arranged in wired or wireless communication with the handle position sensor of the top unit, and wherein the tool angle controller is configured to alter the inclination angle $\Gamma_1$, $\Gamma_2$, $\alpha_1$, $\alpha_2$ of the tools based on the angular position of the handle.

Advantageously, a wired or wireless communication between a handle position sensor and a tool angle controller allows for a slim design of the cleaning device, and may require relatively few components. Further advantageously, this may allow for individually controllable tools.

In an embodiment according to the first aspect of the present disclosure the inclination angle $\Gamma_1$, $\Gamma_2$, $\alpha_1$, $\alpha_2$ is between −1° and +1° when the handle is arranged substantially vertical. Preferably the inclination angle $\Gamma_1$, $\Gamma_2$, $\alpha_1$, $\alpha_2$ is about 0° when the handle is arranged substantially vertical. In embodiments, the inclination angle $\Gamma_1$, $\Gamma_2$, $\alpha_1$, $\alpha_2$ is between −1° and +1° when the handle is arranged substantially horizontally. Preferably the inclination angle $\Gamma_1$, $\Gamma_2$, $\alpha_1$, $\alpha_2$ is about 0° when the handle is arranged substantially horizontally. In embodiments the inclination angle $\Gamma_1$, $\Gamma_2$, $\alpha_1$, $\alpha_2$ is between +1° and +3° when the handle is arranged substantially transverse with respect to both the vertical and the horizontal orientation. Preferably the inclination angle $\Gamma_1$, $\Gamma_2$, $\alpha_1$, $\alpha_2$ is about 1.5° or about 2° when the handle is arranged substantially transverse with respect to both the vertical and the horizontal orientation.

Alternatively worded, at least two operational modes of the cleaning device may be defined. A first operational mode corresponds to a low-speed cleaning mode whereas a second operational mode corresponds to a high-speed cleaning mode. In the low-speed cleaning mode the angular inclination of the tools is lower than in the high-speed cleaning mode. For example, the high-speed cleaning mode may be selected by holding the handle of the cleaning device inclined with respect to both the vertical and the horizontal. For example, the low-speed cleaning mode may be selected by holding the handle of the cleaning device substantially vertically and/or by holding the handle of the cleaning device substantially horizontally. For example, in the low-speed cleaning mode the inclination of the tools is between minus one (i.e. 1) degree and plus one (i.e. +1) degree, such as about zero (i.e. 0) degrees. For example, in the high-speed cleaning mode the inclination of the tools is between one (i.e. 1) degree and three (i.e. 3) degree, such as about one point five (i.e. 1.5) degrees or two (i.e. 2) degrees.

Advantageously, it now becomes very easy, convenient and intuitive for a user using the cleaning device to select the correct/desired operational mode.

Another option to implement a control element that can be manipulated by the user/operator is e.g. by forming the handle as a control element, wherein the manipulation is defined by a rotational movement of the handle. For example, rotating the handle in a clockwise direction with respect to above-defined Y axis may correspond to a faster speed and thus a larger inclination angle, whereas a counter-clockwise rotation with respect to the above-defined Y axis may correspond to a lower speed and thus a smaller inclination angle, up to the point where the inclination angle becomes zero or negative.

A yet further option to implement a control element that can be manipulated by the user/operator is e.g. by forming the control element as a knob, switch or button, said control element in the form of a knob, switch or button being manipulable with a hand and/or foot of the operator.

In an embodiment according to the first aspect of the present disclosure the inclination angle $\Gamma_1$, $\Gamma_2$, $\alpha_1$, $\alpha_2$ of the rotatable tools can be varied in a stepless manner.

Advantageously, this allows to reach virtually any forward speed, as long as it is between the minimum and maximum speed. As explained in the above, the minimum speed may be negative or zero.

In an embodiment according to the first aspect of the present disclosure propulsion of the cleaning device is solely effected by the propulsive force resulting from the combination of inclination and counter-rotation of the tools.

Advantageously, this omits the need for any externally driven wheels or other propulsive drives. This reduces the part-count of the cleaning device, reduces the number of components that can fail, results in a less expensive manufacturing price and, possibly, is also more energy efficient.

In an embodiment according to the first aspect of the present invention the frame is wheelless, such that no traces are left on the floor after cleaning.

In an embodiment in accordance with the first aspect of the present invention a roller wheel may be present on the frame, e.g. at the side thereof opposite to the side where the tools are arranged. Such a roller wheel may e.g. allow easy transportation of the cleaning device—similar to rolling a suitcase instead of carrying it.

In an embodiment according to the first aspect of the present disclosure the inclination angle $\alpha_1$, $\alpha_2$ is defined in or has a component when projected on an imaginary XZ plane of an imaginary XYZ axis system that has an origin in a central position with respect to the at least two tools, an X-axis that coincides with a propulsion direction of the self-propelled cleaning device, a Z-axis that coincides with a direction normal to the floor surface, and a Y-axis that points to the right of the frame and completes the XYZ axis system.

In an embodiment according to the first aspect of the present disclosure the drive is configured to rotate the tools with a variable rpm, to vary the propulsive force exerted on the frame. For example the rpm of both tools may be controlled together or individually. When the rpm of both tools is controlled together, the forward speed of the cleaning device may be controlled. When the rpm of both tools is controlled individually, it becomes possible to make a turn with the cleaning device by having one of the tools rotating slightly slower than the other of the two tools.

Control of the number of revolutions of the tools per minute may be implemented in combination with the feature of a variable inclination angle, but it may also be implemented independently of the feature of a variable inclination angle. Therefore, according to a second aspect of the disclosure, a self-propelled cleaning device for cleaning a floor is provided, the self-propelled cleaning device having a frame which includes at least two tools and at least one drive, the at least two tools being rotatable on the surface by said at least one drive, wherein, when the self-propelled cleaning device is placed on the surface, each of the tools is inclined over at least one respective angle $\Gamma_1$, $\Gamma_2$, $\alpha_1$, $\alpha_2$ with respect to the surface, and wherein the two tools are configured to rotate in mutually different directions in an operative state of the self-propelled cleaning device, thereby exerting a propulsive force on the frame, wherein the drive is configured to rotate the tools with a variable rpm, to vary the propulsive force exerted on the frame.

Advantages obtained with the invention according to the second aspect of the present disclosure are similar to the advantages described in relation to the first aspect of the present disclosure. Also by varying the rpm of the tools, the forward speed of the cleaning device may be controlled. It is however noted that, when the rpm is reduced too much, also cleaning may be less optimal—if the tools do not rotate they do not clean the surface.

Additional features and embodiments described in the above in relation to the first aspect of the present disclosure only, may also be advantageous to implement in a cleaning device according to the second aspect of the disclosure.

According to a third aspect of the invention, a method for cleaning a surface is presented. According to this method, use is made of a self-propelled cleaning device according to either the first aspect or the second aspect as described in the above.

A fourth aspect of the present invention relates to a user-guided cleaning device for cleaning a surface, having:

a frame which includes at least two tools and at least one drive, for rotating the at least two tools on the surface, and at least one handle moveable forwards and backwards with respect to the frame and moveable sideways with respect to the frame wherein the two tools are configured to rotate in mutually different directions in an operative state of the self-propelled cleaning device, thereby exerting a propulsive force on the frame, characterized, in that the handle and the frame are connected via a deformable elastomeric element.

Known from e.g. EP3508106A1 is a user-guided cleaning device wherein the handle of the cleaning device can be rotated about two axis; an axis parallel to the direction of movement and an axis perpendicular to the direction of movement of the cleaning device. As such, the handle can be rotated over 360 degrees compared to the frame holding the tools. Both rotation axis are defined by physical joints or hinges, which can wear and which can function less optimally if they become dirty.

Known from e.g. WO2020/234904 A1 is a user-guided cleaning device wherein the handle of the cleaning device can be rotated about 360 degrees with respect to the frame. The movement is achieved via a 'lengthened elastic and internally hollow push element' which, in practice, is a coil spring. A disadvantage of using a coil spring to effect the moveability of the handle with respect to the frame is that wires and fingers of users can get stuck in between the coils of the spring.

According to the fourth aspect of the disclosure the above-mentioned solutions are improved by providing a deformable elastomeric element. As used herein, a deformable elastomeric element is preferably a solid or substantially solid elastomeric element that allows a component attached to it to be moved in one or more directions due to the inherent flexibility of the elastomeric material the element is made of. In particular, connecting the frame and the handle with each other via such a deformable elastomeric element allows the handle to move in one or more directions with respect to the frame. In principle any elastomeric material, man-made or natural, can be used for the deformable elastomeric element. In principle the deformable elastomeric element can have any shape. For example it may have a cylindrical shape, having the same cross sectional area at every height. For example, it may have one or more cut-outs, to make it more flexible in one direction than in another direction. For example it may have a diabolo shape, to increase the movement accuracy.

Depending on the specifications, a left-right movement of the handle may be achieved through the elastomeric element, the elastomeric element being rigid in the forward-backward direction and the forward-backward movement of the handle e.g. being provided via a hinge. In an alternative embodiment, a forward-backward movement of the handle may be achieved through the elastomeric element, the elastomeric element being rigid in the sidewards direction and the sidewards movement of the handle e.g. being provided via a hinge. In yet another embodiment the elastomeric element may allow both a left-right movement and a forward-backward movement of the handle with respect to the frame to effectively allow a 360 degree rotation of the handle with respect to the frame.

In a particularly advantageous embodiment, when the cleaning device comprises a hinge allowing the forward-rearward movement (the movement about a rotation axis perpendicular to the movement direction) of the handle with respect to the frame, the hinge may simultaneously define the turbine housing. In such an embodiment the other movement may be implemented though a deformable elastomeric element as described in the above, but it is also possible that the other movement is absent or that the other movement is implemented with a second hinge.

It goes without saying that embodiments and features described in the above or in the below with respect to other aspects of the present disclosure may advantageously also be implemented on a cleaning device according to the fourth aspect of the disclosure.

The above-mentioned and other features and advantages of the disclosure will be best understood from the following description referring to the attached drawings. In these drawings, like reference numerals denote identical parts or parts performing an identical or similar function or operation.

DETAILED DESCRIPTION OF THE DRAWINGS

In the below description, all figures are described together, unless where reference is made to a specific figure. Some of the more important aspect of the disclosed cleaning device are thematically grouped to be explained in more detail.

Propulsion Principle

Figure 1:
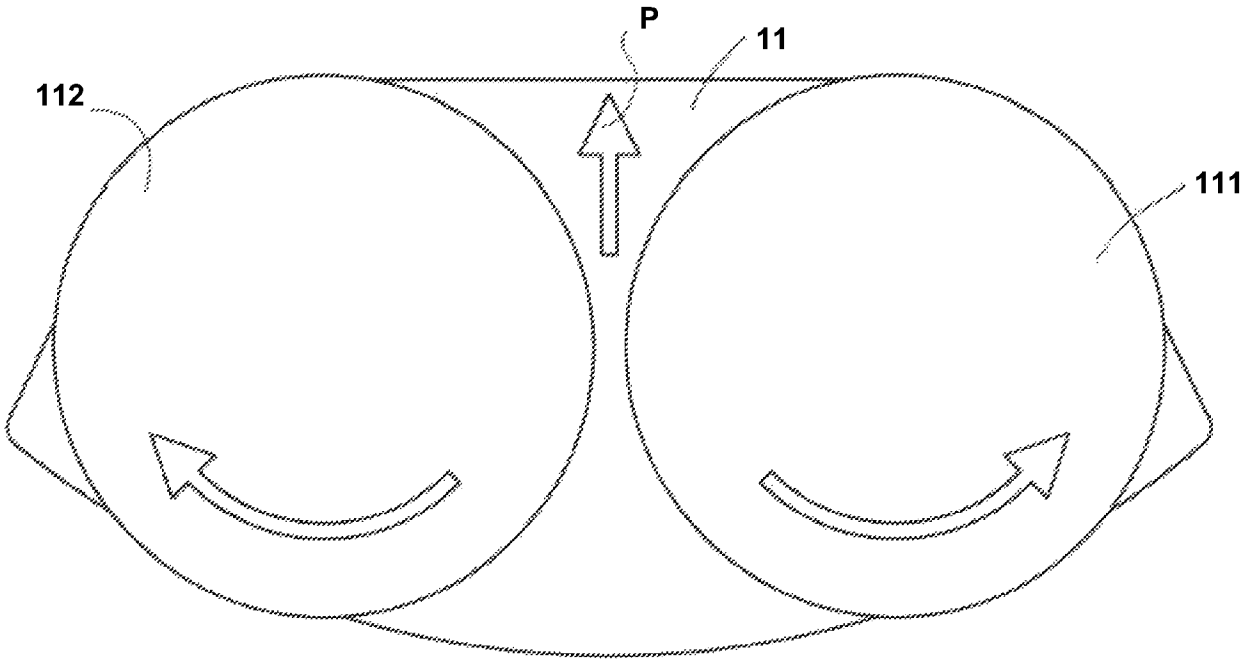
FIG. 1 very schematically illustrates an embodiment of the cleaning device according to the present disclosure from the below.
Figure 3A:
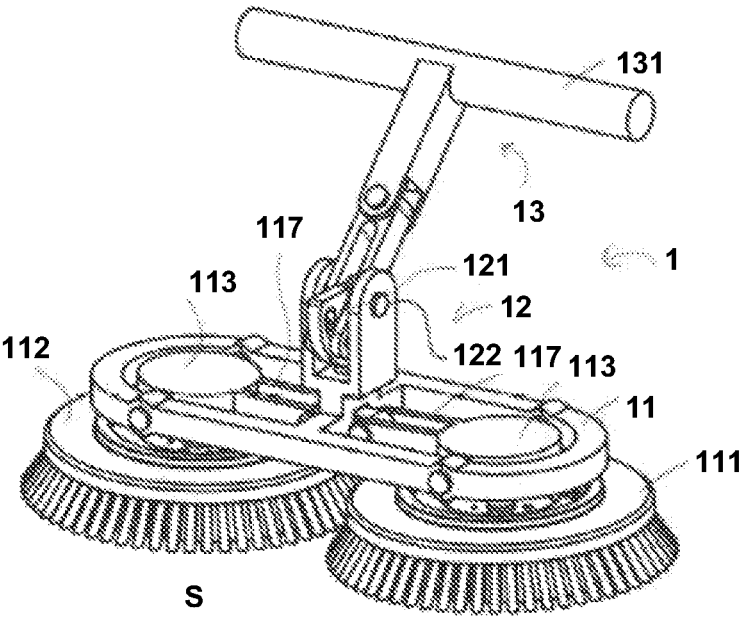
FIGS. 3A and 3B very schematically illustrate the cleaning device of FIGS. 2A and 2B, in a second cleaning position.

Although the propulsion principle of self-propelled cleaning devices 1, 100 is in principle known in the field, it is here briefly described. With reference to FIGS. 1 and 3A, a self-propelled cleaning device 1 with two tools 111, 112 is shown. Each of the tools 111, 112 is driven by a drive 113, so that the tools 111, 112 are rotatable on a surface S to be cleaned. As is shown in FIG. 3A, each of the tools 111, 112 are inclined at an angle $\Gamma_1$, $\Gamma_2$ with respect to the horizontal orientation. As is shown in FIG. 1, each of the tools 111, 112 in operation rotate in mutual different directions, i.e. they counter-rotate. As a result of this inclination, a pressure on the tools 111, 112 is higher near the centre of the frame 11 than near the outer side of the frame 11. The combination of counter-rotation and inclination generates a propulsive force P. As a result of the propulsive force P the cleaning device 1, upon operation, moves forward and is self-propelled.

In principle, as will be explained in more detail below, the magnitude and direction of the propulsive force P depends on at least three factors: the pressure applied on the tools 111, 112, the inclination angles $\Gamma_1$, $\Gamma_2$ of the tools 111, 112, and the rpm of the tools 111, 112.

As will be clear from the above text and FIG. 1, it is possible to propel the cleaning device 1, 100 without any other propulsive means, such that propulsion of the cleaning device 1, 100 is effected solely by the propulsive force P resulting from the combination of inclination and counter-rotation of the tools 111, 112.

Vary Forward Speed by Modification of Tool Inclination Angle

One option to vary the forward speed of the cleaning device 1, 100 is to vary the inclination angles $\Gamma_1$, $\Gamma_2$ of the tools 111, 112. The tools 111, 112 may principally be inclined over two different angles $\Gamma$, $\alpha$, and/or a combination of the two different angles $\Gamma$, $\alpha$. In the shown figures, mainly visible in FIGS. 3B and 5A, the two different angles $\Gamma$, $\alpha$ are shown.

Figure 3B:
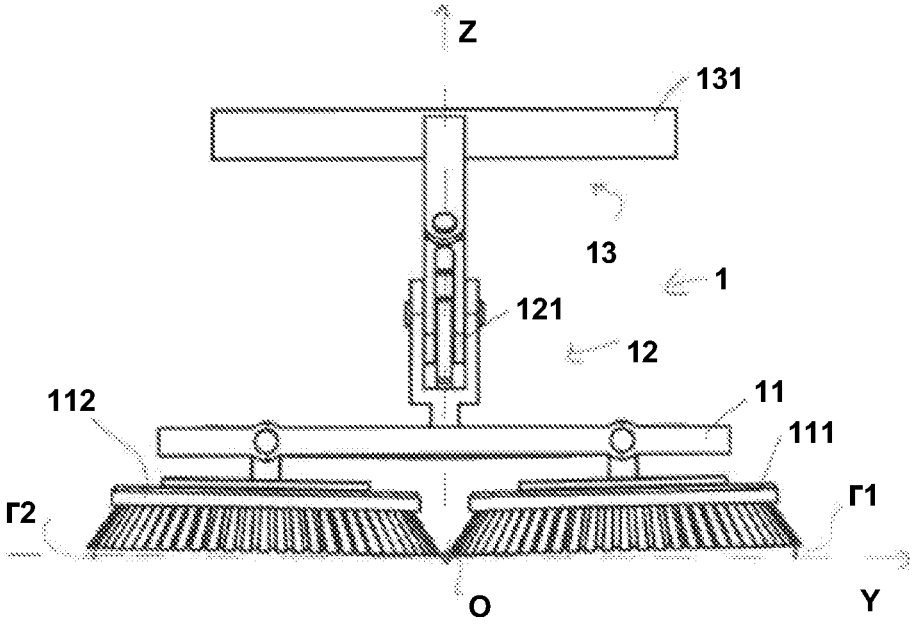

The inclination angle $\Gamma$, shown in FIG. 3B, is defined as an angle in or having a component when projected on an imaginary YZ plane of an imaginary XYZ axis system. The XYZ axis system has an origin O in a central position with respect to the tools 111, 112, an X-axis that coincides with a propulsion direction of the self-propelled cleaning device 1, 100, a Z-axis Z that coincides with a direction normal to the surface, and the Y-axis Y points to the right of the frame 11 and completes the XYZ axis system.

That is, the X axis points forwards out of the paper in FIG. 3B, the Z-axis Z corresponds to the vertical in FIG. 3B and the Y-axis Y points to the right in FIG. 3B.

Figure 5A:
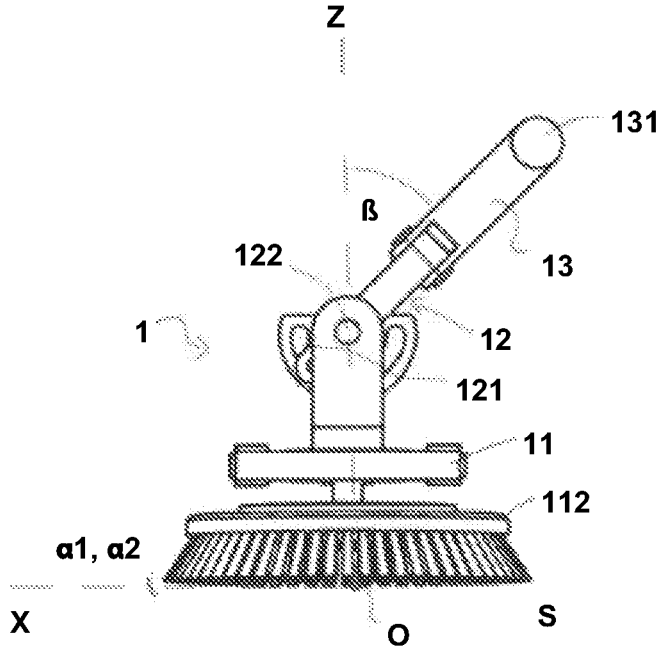
FIGS. 5A and 5B very schematically illustrate the cleaning device in the same cleaning position as FIGS. 3A and 3B, but now from the side and from below.
Figure 5B:
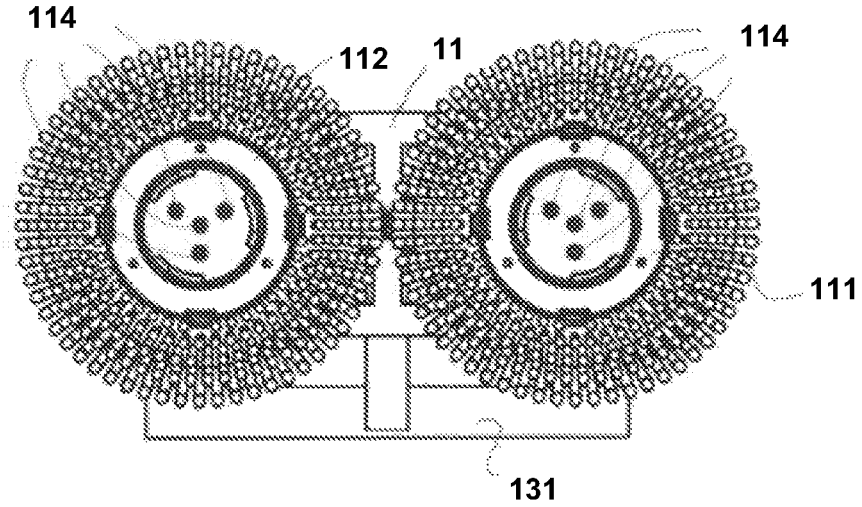
Figure 6A:
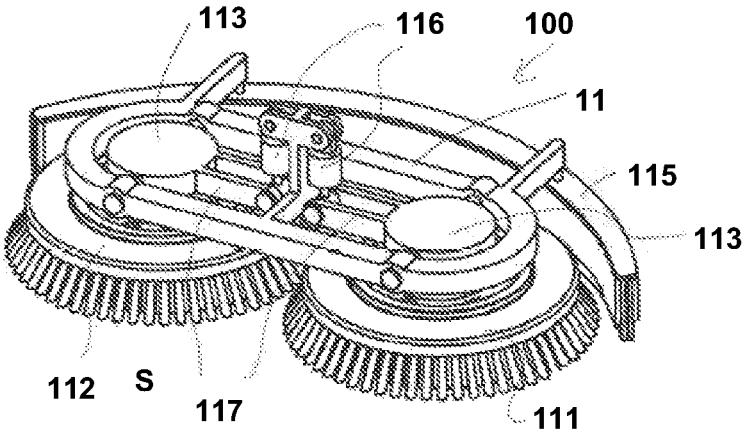
FIGS. 6A-6D very schematically illustrate a further embodiment of the cleaning device in accordance with the present disclosure.
Figure 6B:
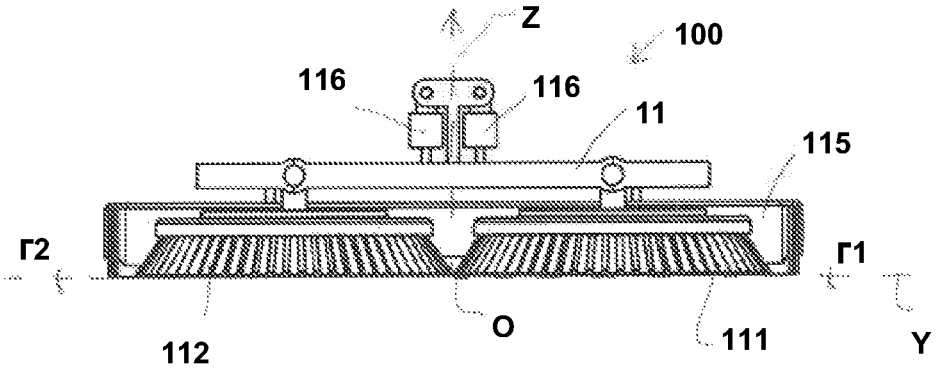
Figure 6C:
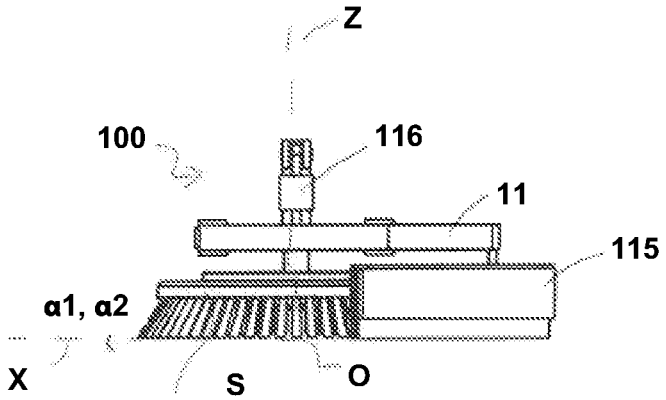
Figure 6D:
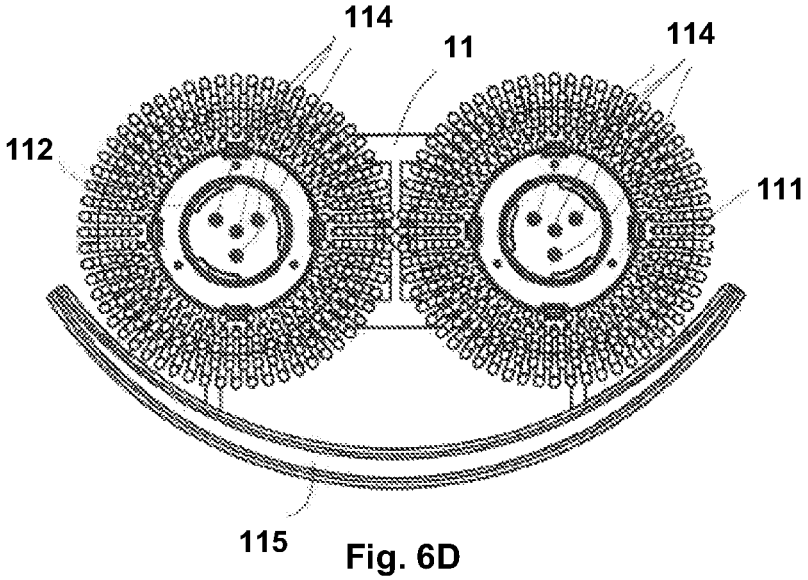

The inclination angle $\alpha$, shown in FIG. 5A, is defined as an angle in or having a component when projected on an imaginary XZ plane of same imaginary XYZ axis system. That is, the X axis points forwards in FIG. 5A, the Z-axis Z corresponds to the vertical in FIG. 5A and the Y-axis Y points out of the paper in FIG. 5A.

In the shown FIGS. 3B and 5A the tools 111, 112 have a positive inclination angle $\Gamma_1$, $\Gamma_2$ in the YZ plane and an inclination angle $\alpha_1$, $\alpha_2$ of zero in the XZ plane. In the FIGS. 2B and 4B the tools 111, 112 have an inclination angle $\Gamma_1$, $\Gamma_2$ of zero in the YZ plane and an inclination angle $\alpha_1$, $\alpha_2$ of zero in the XZ plane.

When the inclination angles $\Gamma_1$, $\Gamma_2$ are both zero, pressure is equally distributed over the tool area and no net propulsive force P is generated. When the inclination angles $\Gamma_1$, $\Gamma_2$ are positive, a positive propulsion force P is generated as described in the above. When the inclination angles $\Gamma_1$, $\Gamma_2$ are increased, the propulsion force P becomes larger. When the inclination angles $\Gamma_1$, $\Gamma_2$ are negative, pressure on the tools 111, 112 is higher near the outside of the frame 11 than near the centre of the frame 11 and a negative propulsion force P is generated.

Vary Forward Speed by Modification of Tool Rpm

Another option to vary the forward speed of the cleaning device 1, 100 is to vary the rotational speed of the tools 111, 112. Therefore, in the shown figures, the drive 113 is configured to rotate the tools 111, 112 with a variable rpm. When the tools 111, 112 rotate with a lower rpm, the propulsion force P decreases. When the tools 111, 112 rotate with a higher rpm, the propulsion force P increases. Also using this alternative option, a change in forward speed may be obtained.

Making a Turn

When the cleaning device 1 is of the hand-guided type, a turn may easily be made with the cleaning device by exerting a torque moment on the frame by turning handle 131 about the Z-axis.

Alternatively, a turn can be made automatically. This is possible when the cleaning device 1, 100 is of the hand-guided type, but this is mainly advantageous when the cleaning device 1, 100 is of the robotic or autonomous type. To make an automatic turn several options are possible as described in the below. The main goal to achieve is altering the direction of the propulsion force P. It should no longer align with the X-axis X but is should point to the right or to the left to make a right or a left turn.

One way to achieve this is by changing the rpm of one of the tools 111, 112 with respect to the other of the tools 111, 112. This will ensure that a turn is made in the direction of the fastest rotating tool 111, 112.

Another way to achieve this is by changing the inclination $\Gamma_1$, $\Gamma_2$ in the YZ plane of one of the tools 111, 112. When one of the tools 111, 112 has a higher inclination $\Gamma_1$, $\Gamma_2$ than the other tools 111, 112 the tool 111, 112 with a higher inclination $\Gamma_1$, $\Gamma_2$ pushes on the surface harder and the cleaning device 1, 100 is pulled in that direction.

Yet another way to achieve a turn is to change the inclination $\alpha_1$, $\alpha_2$ in the XZ plane of one of the tool 111, 112. This will alter the point on the surface S where the most pressure is applied by the tool 111, 112 and this will also tilt the propulsion force P.

Cleaning Task 1—Spot Cleaning

A first task that the cleaning device 1, 100 as presented herein can fulfil with great ease and with excellent success is spot cleaning—i.e. high intensity cleaning of a relatively small area of the surface to be cleaned. Preferably, to effect this spot cleaning, the tools 111, 112 are rotated with a relative high rpm and with a small inclination angle $\Gamma_1$, $\Gamma_2$, $\alpha_1$, $\alpha_2$ of e.g. between −1 degree and +1 degree, e.g. of zero degree. The cleaning device 1, 100 will then move slowly over the area to be spot-cleaned while the tools rotate at a high level, resulting in high intensity cleaning. It is noted that spot cleaning is less effective when the rpm is reduced to have the cleaning device move slower. For example, this setting can be obtained automatically, using sensors, or by having the handle 131 in a vertical position—as will be described in more detail in the below.

Cleaning Task 2—Cleaning in Corners

A second task that the cleaning device 1, 100 as presented herein can fulfil with great ease and with excellent success is cleaning in corners. For this, high precision is needed and it is in that respect beneficial when the cleaning device 1, 100 can be moved slowly. This can be obtained by having a small inclination angle $\Gamma_1$, $\Gamma_2$, $\alpha_1$, $\alpha_2$ of e.g. between −1 degree and +1 degree, e.g. of 0.5 degree. Possibly, when corners are cleaned also the rpm can be adjusted to a lower level, when cleaning with a higher intensity is not needed. For example, this setting can be obtained automatically, using sensors, or by having the handle 131 in a near vertical position—as will be described in more detail in the below.

Cleaning Task 3—Cleaning Below Objects

A third task that the cleaning device 1, 100 as presented herein can fulfil with great ease and with excellent success is cleaning below objects. For this, high precision is needed and it is in that respect beneficial when the cleaning device 1, 100 can be moved slowly. This can be obtained by having a small inclination angle $\Gamma_1$, $\Gamma_2$, $\alpha_1$, $\alpha_2$ of e.g. between −1 degree and +1 degree, e.g. of 0 degree or 0.5 degree. Possibly, when an area of the surface S below an object is cleaned also the rpm can be adjusted to a lower level, when cleaning with a higher intensity is not needed. In other cases, when the area is relatively dirty, cleaning at the normal rpm however may be desired. For example, this setting can be obtained automatically, using sensors, or by having the handle 131 in a horizontal position—as will be described in more detail in the below.

Cleaning Task 4—Cleaning a Large Unobstructed Area

A fourth task that the cleaning device 1, 100 as presented herein can fulfil with great ease and with excellent success is cleaning a large unobstructed and mildly dirty surface fast and properly. For this, high speed is preferred and it is beneficial in that respect when the speed of the cleaning device 1, 100 can be increased. This can be obtained by having a large inclination angle $\Gamma_1$, $\Gamma_2$, $\alpha_1$, $\alpha_2$ of e.g. between 1 degree and 3 degrees, e.g. of 1.5 degree or 2 degree. Depending on the dirtiness of the surface S and the speed with which it is cleaned, it may be desirable to also adjust the rpm of the tools 111, 112—to obtain the most satisfactory cleaning result. For example, this setting can be obtained automatically, using sensors, or by having the handle 131 in a tilted position—as will be described in more detail in the below.

Hand-Guided Cleaning Device

In the FIGS. 2, 3, 4 and 5 the cleaning device 1 is of the hand-guided type. The device 1 comprises a handle 131 that can be held by a user and that can be used to guide the device 1 along a surface S. The handle 131 is part of a top part 13, which top part 131 is connected to the frame 11 via an articulated arrangement 12. The articulated arrangement 12 allows the top part 13 to be pivoted in all angular direction with respect to the frame 11, so that the top part 13, including handle 131, can be moved backwards, forwards, to the left, to the right, and any combination thereof.

For example, the hand-guided cleaning device 1 may be a so-called scrubber-drier that has a water outlet 114 at or near the tools 111, 112 and a suction strip 115 arranged behind the tools 111, 112.

Robotic or Autonomous Cleaning Device

In FIGS. 6A-6D the cleaning device 100 is of the robotic type and does not comprise a handle nor an articulated arrangement. The inclination angle $\Gamma_1$, $\Gamma_2$, $\alpha_1$, $\alpha_2$ of the tools 111, 112 of the robotic cleaning device 100 are in the present embodiment controlled by tool angle controllers 116. The shown robotic cleaning device 100 comprises two tool angle controllers 116, one associated with each of the tools 111, 112 so that the tools 111, 112 can be individually controlled by the tool angle controllers 116. That is, the inclination angle $\Gamma_1$, $\alpha_1$ of one of the tools 111 may be different compared to the inclination angle $\Gamma_2$, $\alpha_2$ of the other of the tools 112.

As will be appreciated, the robotic cleaning device 100 is wheelless; propulsion of the robotic cleaning device 100 is solely effected by the propulsive force P generated by the tools 111, 112 in the manner described earlier with reference to FIG. 1. Therefore, in contrast to known robotic cleaning tools which do have wheels, the presented cleaning device 100 will not leave any marks on the cleaned surface S as there are no wheels driving over a mildly moist surface S.

For example, the autonomous cleaning device 100 may be a so-called scrubber-drier that has a water outlet 114 at or near the tools 111, 112 and a suction strip 115 arranged behind the tools 111, 112.

Changing the Inclination Angle of the Tools

There are many different ways to change the inclination of the tools 111, 112, several of which are described in a bit of detail here for illustrative purposes only. However, a person skilled in the art will be able to come up with many more solutions, each of which are deemed to be covered by the appended claims. It may be preferred that the inclination angle $\Gamma_1$, $\Gamma_2$, $\alpha_1$, $\alpha_2$ of the rotatable tools 111, 112 can be varied in a stepless manner.

When the cleaning device 100 is of the robotic type, it may e.g. comprise a tool angle controller 116 which is configured to alter the inclination angle $\Gamma_1$, $\Gamma_2$, $\alpha_1$, $\alpha_2$ of the tools 111, 112 as discussed in the above in relation to FIGS. 6A-6D. The tool angle controller 116 may e.g. receive input from a sensor that makes a scan of the environment or the surface S. Alternatively, the tool angle controller 116 may receive input from a pre-set program.

Figure 7A:
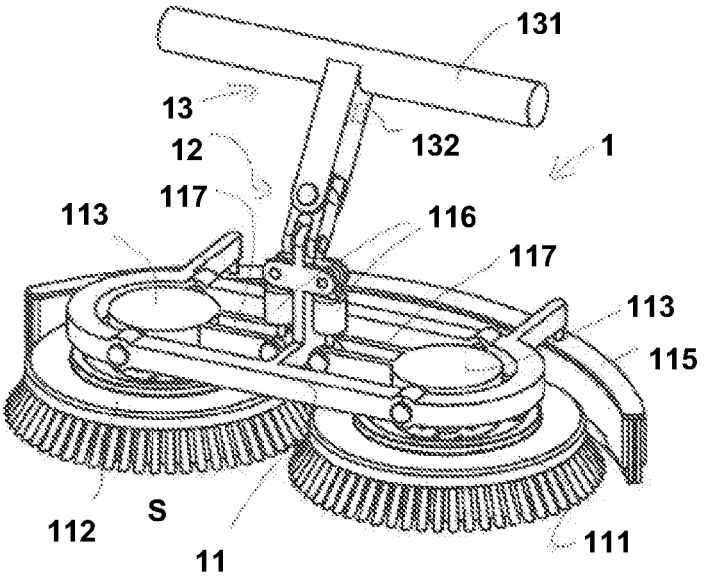
FIGS. 7A and 7B very schematically illustrate a yet further embodiment of the cleaning device in accordance with the present disclosure.
Figure 7B:
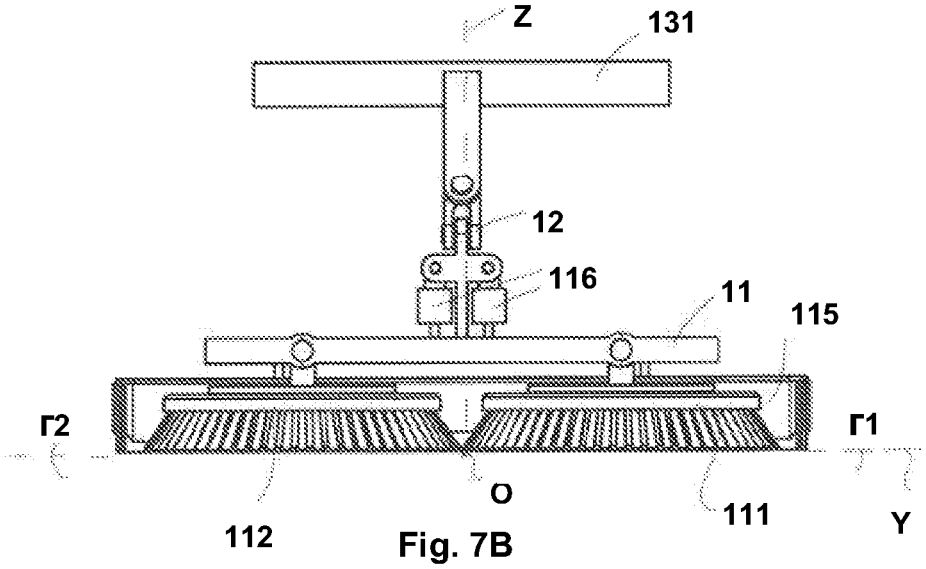

Also when the cleaning device 1 is of the hand-guided type, control of the inclination of the tools 111, 112 may be effected through manipulation of a control element 13, 131. For example, the device 1 may e.g. comprise a tool angle controller 116 which is configured to alter the inclination angle $\Gamma_1$, $\Gamma_2$, $\alpha_1$, $\alpha_2$ of the tools 111, 112, as is shown in FIGS. 7A and 7B. The tool angle controller 116 may e.g.

receive input from a handle position sensor 132, and base the tool inclination angle $\Gamma_1$, $\Gamma_2$, $\alpha_1$, $\alpha_2$ on the angular position $\beta$ of the handle 131 with respect to the Z-axis Z. For example, the handle position sensor 132 may determine a backwards and/or forwards movement of the handle 131, and vary the inclination angle $\Gamma_1$, $\Gamma_2$, $\alpha_1$, $\alpha_2$ of the tools 111, 112 based on the movement of the handle 131. In this embodiment the top part 13 is the control element, and the backwards and/or forwards movement of the top part 13 is the manipulation by the operator.

Figure 2A:
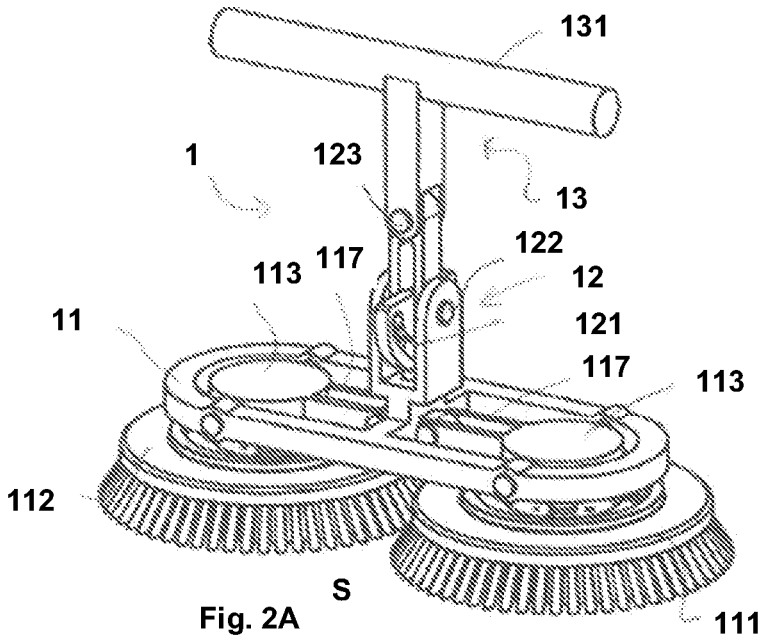
FIGS. 2A and 2B very schematically illustrate an embodiment of the cleaning device in respectively an isometric front view and a front view, in a first cleaning position.
Figure 2B:
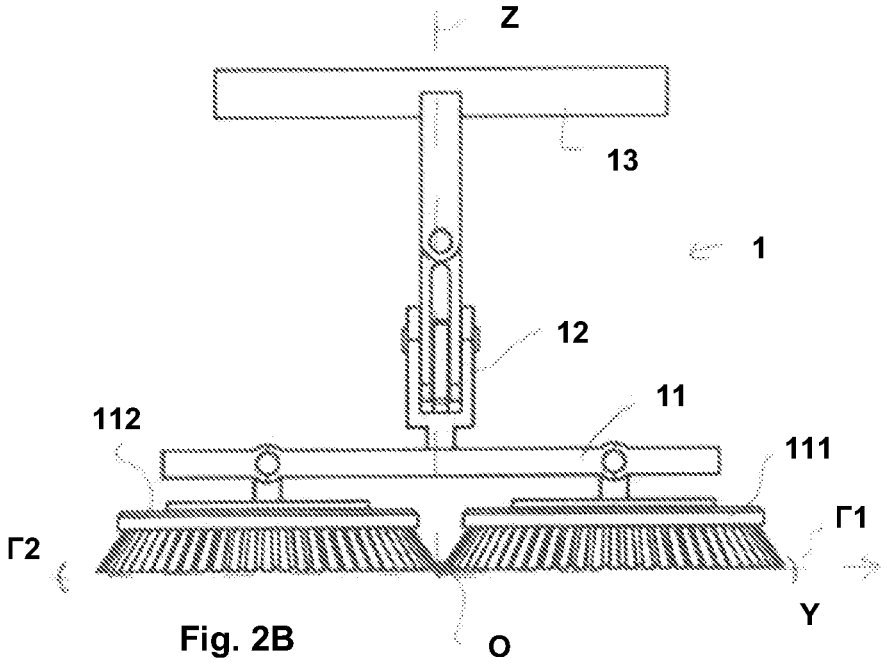

Another possibility is to mechanically link a movement of the handle 131 or top part 13 to the movement of the tools 111, 112, as is shown in FIGS. 2-4. When comparing FIGS. 2A and 3A, one can see that a movement of the handle 131 in the backwards direction results in a downwards movement of hinge 122 and, in turn, a deflection of levers 117. The deflection of levers 117 ultimately alters the inclination angle $\Gamma_1$, $\Gamma_2$, of the tools 111, 112. As shown, the inclination angles $\Gamma_1$, $\Gamma_2$, are only changed in the YZ plane and with the same amount, but variants of such a linkage system would also allow to individually address the tools 111, 112 and/or to change the inclination angle $\alpha_1$, $\alpha_2$ in the XZ plane.

Figure 4A:
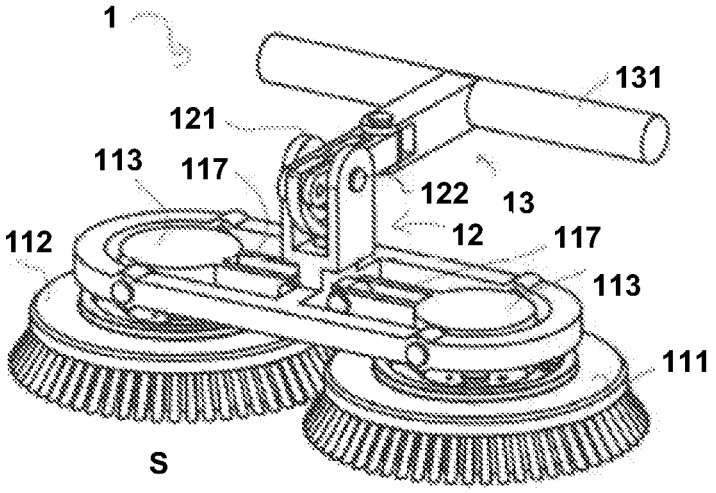
FIGS. 4A and 4B very schematically illustrate the cleaning device of FIGS. 2A and 2B, in a third cleaning position.
Figure 4B:
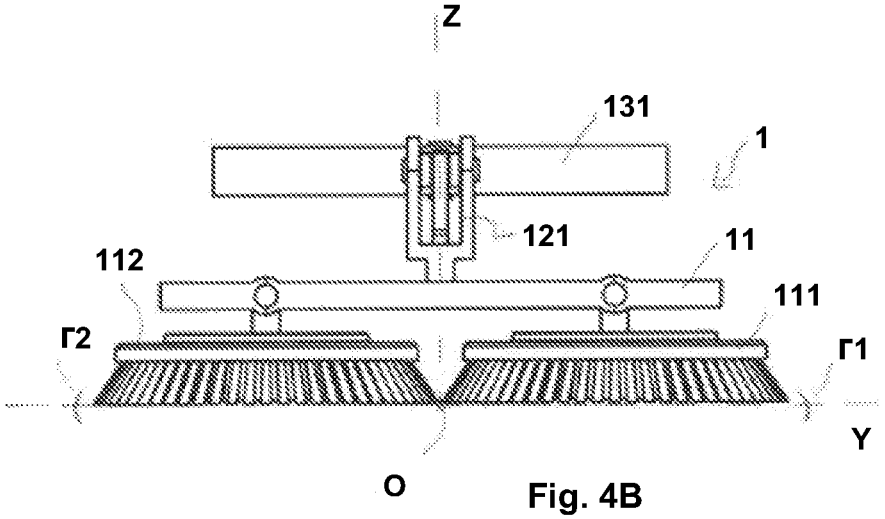

Comparing now FIGS. 3A and 4A, one can see that when the handle 131 is moved further backwards, hinge 122 is moved back up again and, in turn, levers 117 are in the same neutral undeflected position as in FIG. 2A such that the inclination angle $\Gamma_1$, $\Gamma_2$ of the tools 111, 112 is again zero.

This movement of the tool inclination angle $\Gamma_1$, $\Gamma_2$ between two different inclinations when the handle 131 is moved between three different positions is made possible by the C-shaped guidance path along which the handle 131 moves in the mechanical linkage system 121. Also in this embodiment, top part 13 is the control element whereas the backwards and/or forwards movement of the handle 131 is the manipulation movement.

Other (non-shown) options to control the tool inclination are e.g. the rotational movement of the handle 131 which may corresponds to an alteration of the tool 111, 112 inclination angle $\Gamma_1$, $\Gamma_2$, e.g. through sensors and/or the manipulation of a switch, button or knob, e.g. with a hand or foot of the user, to alter the inclination angle $\Gamma_1$, $\Gamma_2$ of the tools 111, 112.

Movement of the Handle with Respect to the Frame

Turning now to FIG. 2A, in this embodiment an articulated arrangement 12 allows the handle 131 to be moved forwards and backwards with respect to the user through first hinge 122. First hinge 122 defines a rotation axis perpendicular to the direction of movement, to allow the handle 131 to be moved backwards and forwards. Second hinge 123 allows the handle 131 to be moved to the left and the right with respect to the user, about a rotation axis that is arranged parallel to the direction of movement. By implementing a first hinge 122 and a second hinge 123, the two hinges 122, 123 having rotation axes that are perpendicular to each other, the handle 131 can be rotated 360 degrees with respect to the frame.

Figure 8:
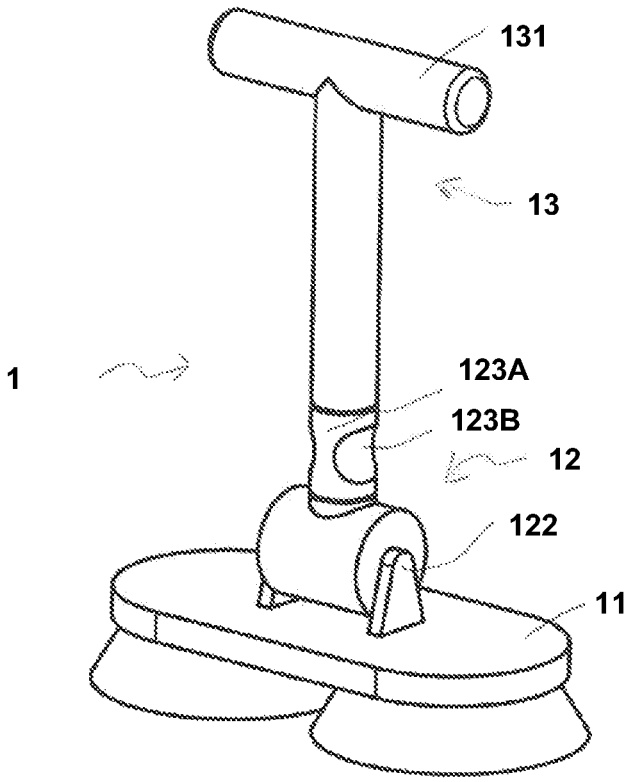
FIG. 8 very schematically illustrates a cleaning device having a deformable elastomeric element and a hinge.

Turning now to FIG. 8, shown is a cleaning device with a frame 11, an articulated arrangement 12 and a top part 13 including handle 131. The top part 13 is connected to the frame 11 via articulated arrangement 12. Articulated arrangement comprises a first hinge 122, and a deformable elastomeric element 123A. The first hinge 122 allows the handle 131 to be rotated about a first rotation axis. The rotation axis is perpendicular to the direction of movement so that, when seen from the perspective of the user, the handle 131 can be moved forwards and backwards about the first hinge 122. The elastomeric element 123A here has a non-constant cross-section—non-constant with regards to the shape as well as the size—with cut-outs 123B. The cut-outs locally weaken the elastomeric element 123A such that it becomes more flexible in one direction than in other directions. As such, the elastomeric element 123A is relatively rigid in the movement direction corresponding to the direction of movement whereas it is relatively flexible in the direction coinciding with the first rotation axis. As such, the elastomeric element 123A allows the handle 131 to be moved to the left and the right with respect to the user.

Figure 9:
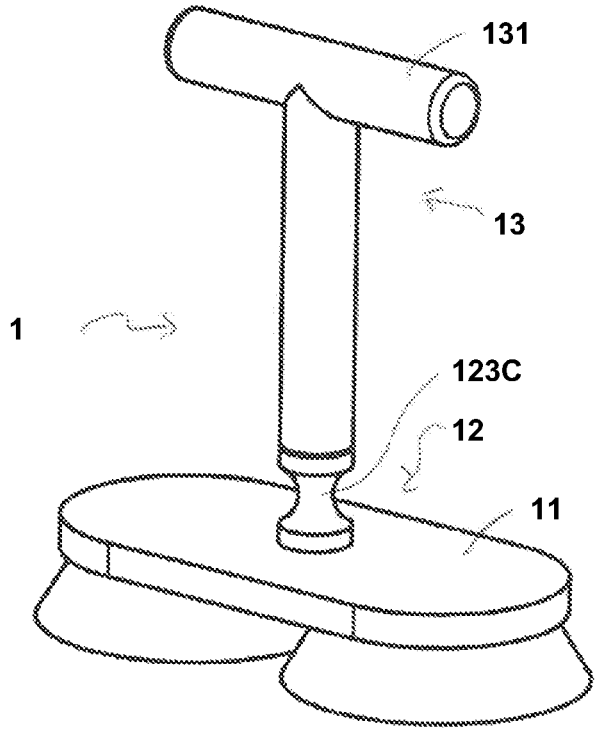
FIG. 9 very schematically illustrates a cleaning device having a deformable elastomeric element according to a second embodiment thereof.

Turning now to FIG. 9, another embodiment of a user-guided cleaning device is shown. The user-guided cleaning device again has a frame 11, a top part 13 including handle 131 and an articulated arrangement 12 connecting the top part 13 and the frame 11. The articulated arrangement 12 is defined by a deformable elastomeric diabolo element 123C having a non-constant, rotationally symmetric shape. Although in this embodiment the cross section is circular in all (horizonal) planes, the diameter of the elastomeric element 123C is non-constant. This rotationally symmetric shape, in combination with the elastomeric material of which the diabolo element is made, has the effect that the handle 131 can be moved in any direction with respect to frame 11 with a relatively large accuracy—again resulting in a handle 131 that can be moved 360 degrees with respect to the direction normal to the surface to be cleaned.

These aspects of the present invention are alternatively defined by means of the below clauses:

CLAUSES

1. A self-propelled cleaning device (1, 100) for cleaning a surface (S), having a frame (11) which includes at least two tools (111, 112) and at least one drive (113), the at least two tools (111, 112) being rotatable on the surface (S) by said at least one drive (113),
   wherein, when the self-propelled cleaning device (1, 100) is placed on the surface (S), each of the tools (111, 112) is inclined over at least one respective angle $\Gamma_1$, $\Gamma_2$, $\alpha_1$, $\alpha_2$ with respect to the surface (S), and
   wherein the two tools (111, 112) are configured to rotate in mutually different directions in an operative state of the self-propelled cleaning device (1, 100), thereby exerting a propulsive force (P) on the frame (11),
   characterised, in that said inclination angle $\Gamma_1$, $\Gamma_2$, $\alpha_1$, $\alpha_2$ is variable, to vary the propulsive force (P) exerted on the frame (11).
2. The self-propelled cleaning device according to clause 1, wherein said inclination angle $\Gamma_1$, $\Gamma_2$ is defined in or has a component when projected on an imaginary YZ plane of an imaginary XYZ axis system having an origin (O) in a central position with respect to the at least two tools (111, 112), an X-axis (X) of the XYZ axis system coinciding with a propulsion direction of the self-propelled cleaning device (1, 100), a Z-axis (Z) of the XYZ axis system coinciding with a direction normal to the surface (S), and the Y-axis (Y) of the XYZ axis system pointing to the right of the frame (11) and completing the XYZ axis system.
3. The self-propelled cleaning device according to any one of the preceding clauses, being a hand-guided self-propelled cleaning device (1) having an articulated arrangement (12) and a top part (13) that includes at least one handle (131), the top part (13) being connected to the frame (11) via said articulated arrangement (12), the top part (13) being pivotable in all angular directions with respect to the frame (11).

4. The self-propelled cleaning device according to any one of the preceding clauses, being a scrubber-drier (1, 100) having a water outlet (114) at or near the rotatable tools (111, 112) and a suction strip (115) arranged, when seen in a propulsion direction, behind the rotatable tools (111, 112).
5. The self-propelled cleaning device according to clause 3 or 4, wherein the inclination angle $\Gamma_1$, $\Gamma_2$, $\alpha_1$, $\alpha_2$ of said tools (111, 112) is variable by moving the handle (131) of the top part (13) backwards and/or forwards.
6. The self-propelled cleaning device according to clause 5, wherein a mechanical linkage system (121) couples the movement of the handle (131) and the movement of the tools (111, 112).
7. The self-propelled cleaning device according to clause 5, wherein the handle (131) of the top unit (13) includes a handle position sensor (132) configured for determining an angular position of the handle (131), wherein the frame (11) includes an tool angle controller (116) arranged in wired or wireless communication with the handle position sensor (132) of the top unit (13), and wherein the tool angle controller (116) is configured to alter the inclination angle $\Gamma_1$, $\Gamma_2$, $\alpha_1$, $\alpha_2$ of the tools (111, 112) based on the angular position of the handle (131).
8. The self-propelled cleaning device according to any one of the clauses 3-7, wherein the inclination angle $\Gamma_1$, $\Gamma_2$, $\alpha_1$, $\alpha_2$ is between −1° and +1° when the handle (131) is arranged substantially vertical, and/or wherein the inclination angle $\Gamma_1$, $\Gamma_2$, $\alpha_1$, $\alpha_2$ is between −1° and +1° when the handle (131) is arranged substantially horizontally, and/or wherein the inclination angle $\Gamma_1$, $\Gamma_2$, $\alpha_1$, $\alpha_2$ is between +1° and +3° when the handle (131) is arranged substantially transverse with respect to both the vertical and the horizontal orientation.
9. The self-propelled cleaning device according to any one of the preceding clauses, wherein the inclination angle $\Gamma_1$, $\Gamma_2$, $\alpha_1$, $\alpha_2$ of the rotatable tools (111, 112) can be varied in a stepless manner.
10. The self-propelled cleaning device according to any one of the preceding clauses, wherein propulsion of the cleaning device (1, 100) is solely effected by the propulsive force (P) resulting from the combination of inclination and counter-rotation of the tools (111, 112).
11. The self-propelled cleaning device according to any one of the preceding clauses, wherein the frame (11) is wheelless.
12. The self-propelled cleaning device according to any one of the preceding clauses, wherein said inclination angle $\alpha_1$, $\alpha_2$ is defined in or has a component when projected on an imaginary XZ plane of an imaginary XYZ axis system having an origin (O) in a central position with respect to the at least two tools (111, 112), an X-axis (X) of the XYZ axis system coinciding with a propulsion direction of the self-propelled cleaning device, a Z-axis (Z) of the XYZ axis system coinciding with a direction normal to the surface (S), and the Y-axis (Y) of the XYZ axis system pointing to the right of the frame (11) and completing the XYZ axis system.
13. The self-propelled cleaning device according to any one of the preceding clauses, wherein the drive (113) is configured to rotate the tools (111, 112) with a variable rpm, to vary the propulsive force (P) exerted on the frame (11).
14. A self-propelled cleaning device (1, 100) for cleaning a surface (S), having a frame (11) which includes at least two tools (111, 112) and at least one drive (113), the at least two tools (111, 112) being rotatable on the surface (S) by said at least one drive (113),
wherein, when the self-propelled cleaning device (1, 100) is placed on the surface (S), each of the tools (111, 112) is inclined over at least one respective angle $\Gamma_1$, $\Gamma_2$, $\alpha_1$, $\alpha_2$ with respect to the surface (S), and
wherein the two tools (111, 112) are configured to rotate in mutually different directions in an operative state of the self-propelled cleaning device (1, 100), thereby exerting a propulsive force (P) on the frame (11),
characterised, in that the drive (113) is configured to rotate the tools (111, 112) with a variable rpm, to vary the propulsive force (P) exerted on the frame (11).
15. A method for cleaning a surface (S), wherein use is made of a self-propelled cleaning device (1, 100) according to any one of the clauses 1-13 and/or a self-propelled cleaning device (1, 100) according to clause 14.

LIST OF REFERENCE NUMERALS

1 hand-guided self-propelled cleaning device
- 11 frame
  - 111 rotatable tool
  - 112 rotatable tool
  - 113 drive
  - 114 water outlet
  - 115 suction strip
  - 116 tool inclination angle controller
  - 117 lever
- 12 articulated arrangement
  - 121 mechanical linkage system
  - 122 first hinge
  - 123 second hinge
  - 123A deformable elastomeric element
  - 123B cut-outs
  - 123C deformable elastomeric element
- 13 top part
  - 131 handle
  - 132 handle position sensor

100 robotic self-propelled cleaning device
O origin of axis system
P propulsive force
S surface to be cleaned
X X-axis
Y Y-axis
Z Z-axis
$\alpha_1$ inclination angle first rotatable tool when projected on XZ plane
$\alpha_2$ inclination angle second rotatable tool when projected on XZ plane
$\beta$ angle between Z-axis and handle
$\Gamma_1$ inclination angle first rotatable tool when projected on YZ plane
$\Gamma_2$ inclination angle second rotatable tool when projected on YZ plane

The invention claimed is:

1. A user-guided self-propelled cleaning device for cleaning a surface, comprising:
a frame which includes at least two tools and
at least one drive, for rotating the at least two tools on the surface,
a top part being moveable in at least a forwards and/or backwards direction with respect to the frame,
and
wherein the at least two tools are configured to rotate in mutually different directions in an operative state of the self-propelled cleaning device, thereby exerting a propulsive force on the frame, wherein, when the user-guided self-propelled cleaning device is placed on the surface, each of the at least two tools is inclined over at least one respective tool inclination angle $\Gamma_1$, $\Gamma_2$, $\alpha_1$, $\alpha_2$ with respect to the surface, said tool inclination angle $\Gamma_1$, $\Gamma_2$, $\alpha_1$, $\alpha_2$ being variable to vary the propulsive force exerted on the frame, the user-guided self-propelled cleaning device further comprising a lever for controlling said tool inclination angle $\Gamma_1$, $\Gamma_2$, $\alpha_1$, $\alpha_2$, and the device comprising a mechanical linkage system for mechanically linking forwards and/or backwards movement of the top part to a variation in the tool inclination angle $\Gamma_1$, $\Gamma_2$, $\alpha_1$, $\alpha_2$ via a manipulation of the lever.

2. The user-guided self-propelled cleaning device according to claim 1, wherein said tool inclination angle $\Gamma_1$, $\Gamma_2$ is defined in or has a component when projected on an imaginary YZ plane of an imaginary XYZ axis system having an origin in a central position with respect to the at least two tools, an X-axis of the XYZ axis system coinciding with a propulsion direction of the user-guided self-propelled cleaning device, a Z-axis of the XYZ axis system coinciding with a direction normal to the surface, and the Y-axis of the XYZ axis system pointing to the right of the frame and completing the XYZ axis system.

3. The user-guided self-propelled cleaning device according to claim 1, having an articulated arrangement and the top part including at least one handle, the top part being connected to the frame via said articulated arrangement, the top part being pivotable in all angular directions with respect to the frame.

4. The user-guided self-propelled cleaning device according to claim 3, wherein the tool inclination angle $\Gamma_1$, $\Gamma_2$, $\alpha_1$, $\alpha_2$ is between −1° and +1° when the at least one handle is arranged substantially vertical, and/or wherein the tool inclination angle $\Gamma_1$, $\Gamma_2$, $\alpha_1$, $\alpha_2$ is between −1° and +1° when the at least one handle is arranged substantially horizontally, and/or wherein the tool inclination angle $\Gamma_1$, $\Gamma_2$, $\alpha_1$, $\alpha_2$ is between +1° and +3° when the at least one handle is arranged substantially transverse with respect to both the vertical and the horizontal orientation.

5. The user-guided self-propelled cleaning device according to claim 3, wherein the articulated arrangement includes two hinges.

6. The user-guided self-propelled cleaning device according to claim 3, wherein the articulated arrangement includes a hinge and a deformable elastomeric member.

7. The user-guided self-propelled cleaning device according to claim 3, wherein the articulated arrangement includes a deformable elastomeric member.

8. The user-guided self-propelled cleaning device according to claim 1, being a scrubber-drier having a water outlet at or near the at least two tools and a suction strip arranged, when seen in a propulsion direction, behind the at least two tools.

9. The user-guided self-propelled cleaning device according to claim 1, wherein the tool inclination angle $\Gamma_1$, $\Gamma_2$, $\alpha_1$, $\alpha_2$ of the at least two tools can be varied in a stepless manner.

10. The user-guided self-propelled cleaning device according to claim 1, wherein propulsion of the cleaning device is solely affected by the propulsive force resulting from the combination of inclination and counter-rotation of the at least two tools.

11. The user-guided self-propelled cleaning device according to claim 1, wherein said tool inclination angle $\alpha_1$, $\alpha_2$ is defined in or has a component when projected on an imaginary XZ plane of an imaginary XYZ axis system having an origin in a central position with respect to the at least two tools, an X-axis of the XYZ axis system coinciding with a propulsion direction of the self-propelled cleaning device, a Z-axis of the XYZ axis system coinciding with a direction normal to the surface, and the Y-axis of the XYZ axis system pointing to the right of the frame and completing the XYZ axis system.

12. The user-guided self-propelled cleaning device according to claim 1, wherein the drive is configured to rotate the at least two tools with a variable rpm, to vary the propulsive force exerted on the frame.

* * * * *